United States Patent [19]

Sternberg et al.

[11] Patent Number: 4,591,864

[45] Date of Patent: May 27, 1986

[54] FREQUENCY INDEPENDENT TWISTED WAVE FRONT CONSTANT BEAMWIDTH LENS ANTENNA

[75] Inventors: Robert L. Sternberg, Noank, Conn.; Warren A. Anderson, Tiverton, R.I.

[73] Assignee: The United States of America as represented by the Secretary of the Navy, Washington, D.C.

[21] Appl. No.: 503,977

[22] Filed: Jun. 13, 1983

[51] Int. Cl.[4] ..... H01Q 15/02

[52] U.S. Cl. ..... 343/754; 367/23; 367/150

[58] Field of Search ..... 343/753, 754, 909, 911 R, 343/911 L; 369/150, 138, 119, 103; 367/23

[56] References Cited

U.S. PATENT DOCUMENTS

| | | | |
|---|---|---|---|
| 2,566,703 | 9/1951 | Iams | 343/753 |
| 2,736,894 | 2/1956 | Kock | 343/753 |
| 3,936,791 | 2/1976 | Kossoff | 367/138 |
| 4,168,482 | 9/1979 | Sternberg | 367/150 |
| 4,332,018 | 5/1982 | Sternberg et al. | 367/150 |
| 4,348,678 | 9/1982 | Thomas | 343/754 |
| 4,381,509 | 4/1983 | Rotman et al. | 343/754 |

*Primary Examiner*—Eli Lieberman
*Assistant Examiner*—Michael C. Wimer
*Attorney, Agent, or Firm*—Robert F. Beers; Arthur A. McGill; Prithvi C. Lall

[57] ABSTRACT

A frequency independent constant beamwidth lens antenna concept is described. The device may be configured in various ways such as with a cylindrical lens with a retina. The essential feature is that a twisted planar or hyperbolic paraboloidal phase or wave front is formed by the antenna which then in turn produces a frequency independent constant beamwidth beam in the far field of the antenna. Moreover, the frequency independent constant beamwidth beam may be steered or scanned in azimuth without moving the lens.

2 Claims, 4 Drawing Figures

FREQUENCY INDEPENDENT TWISTED WAVE FRONT CONSTANT BEAMWIDTH LENS ANTENNA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention generally relates to acoustic systems and more particularly to underwater sound transmitting or receiving systems requiring the unique property of having a directional constant beamwidth diffraction pattern over a wide band of frequencies either with or without scanning. The invention also has use in the electromagnetic area.

(2) Description of the Prior Art

One acoustic system for providing a directional constant beamwidth diffraction pattern has as its key element a filter plate. The filter plate functions as a lens stop for transmitting low frequencies over an effective aperture of a large area and high frequencies over an effective aperture of a small area. For frequencies between the low and high frequencies the filter plate will transmit an increasing frequency through an effective aperture of decreasing area.

In addition to the above there are various phased or spherical array processing and constant beamwidth beam forming techniques used in both underwater acoustics and in air and equally applicable in electromagnetic areas. Unfortunately each of these techniques requires extensive data processing and/or electronics to control and scan the beams formed.

SUMMARY OF THE INVENTION

This system provides a hyperbolic paraboloidal wave front that propagates a plurality of fan beams in a direction orthogonal to the wave front. The plurality of fan beams form a composite beam that is of a substantially constant beamwidth regardless of frequency. The wave front is formed by a lens and source having particular geometries. Depending on the system chosen, the composite beam may be fixed in space or scanned, or multiple simultaneous composite beams may be formed. The system has particular application in the underwater acoustics field wherein it is desirable to scan an area or volume with a range of frequencies.

DESCRIPTION OF THE PREFERRED EMBODIMENT

Figure 1:
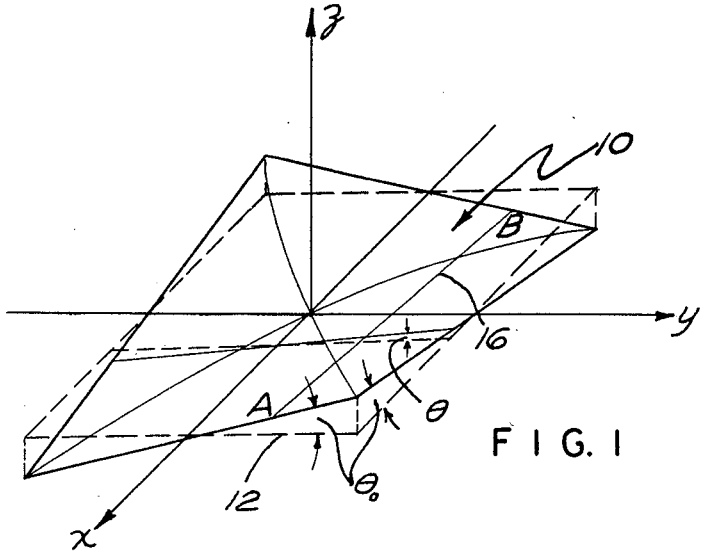
FIG. 1 shows a twisted planar wave front formed in accordance with the present invention.
Figure 2:
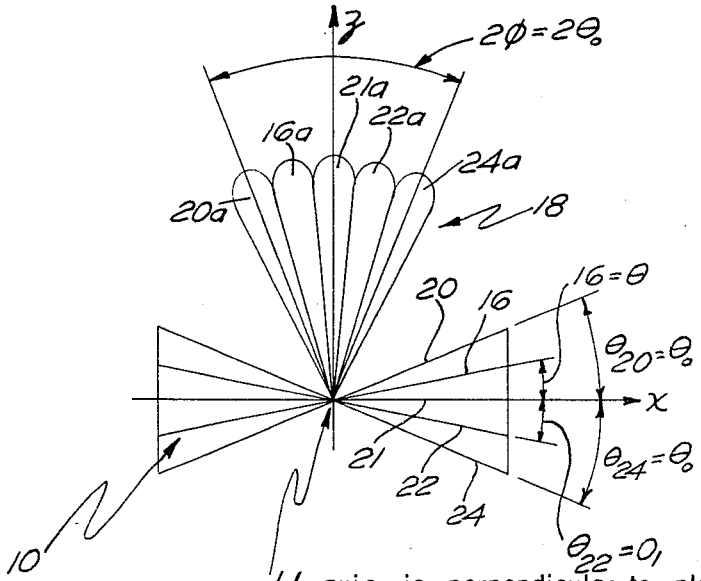
FIG. 2 shows a view of a plurality of fan beams formed from the twisted planar wave front of FIG. 1.
Figure 3:
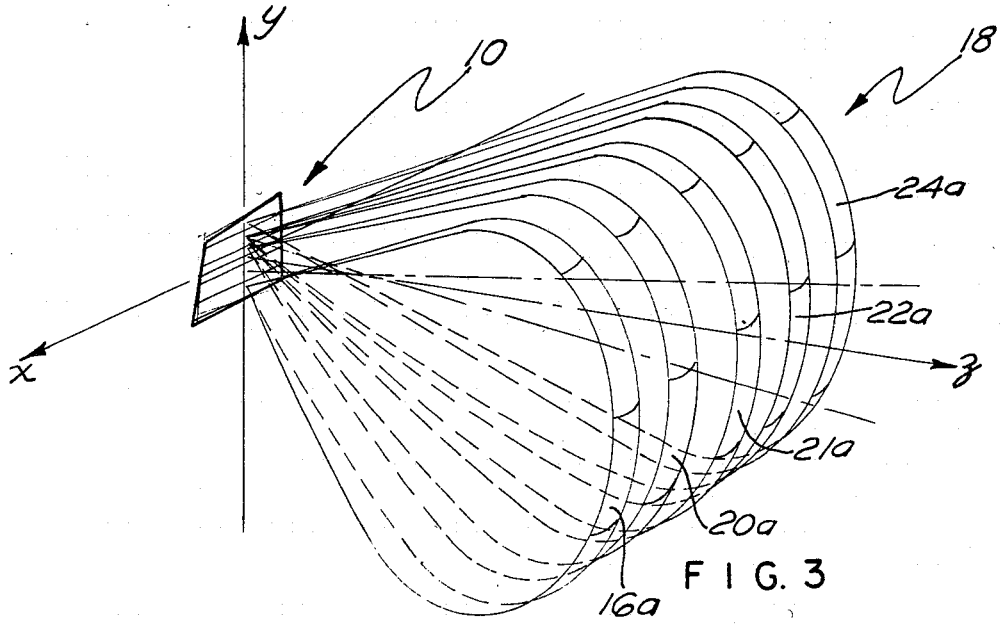
FIG. 3 shows a three-dimensional representation of the fan beams of FIG. 2.

Referring now to FIG. 1 there is shown a twisted planar, or what is the same thing, a hyperbolic paraboloidal wave front 10. The wave front 10 is shown with rotated Cartesian coordinates x,y,z. The location of the wave front 10 can be realized by relating the wave front 10 to a portion of the x,y plane 12 that is shown with dashed lines. The wave front 10 propagates in the positive z direction and has the equation $$z=kyz \qquad \text{(eq. 1)}$$

wherein k is a constant and is small compared to the largest value of x or y used. This makes the constant k small compared to the largest diameter of the lens (not shown in FIG. 1) forming the wave front 10. In frequency bands for which the wavelength is also small compared to the largest x or y used, the beam radiating in the z direction will have approximately constant beamwidths in both the x,z and y,z planes. To see this, it is only necessary to note, for example, that each narrow strip on the twisted planar or hyperbolic parabolodial phase or wave front 10 bordering each line on 10, of the form, y=constant, such as the line AB 16 in FIG. 1, forms a fan beam 16*a* as shown in FIG. 2. Each such fan beam 16*a*, 20*a*, 21*a*, 22*a*, and 24*a* is fanned widely in directions perpendicular to the corresponding strip and has a half-power or 3dB beamwidth in the x,z plane given approximately in degrees by the formula:

$$\text{beamwidth} \simeq 65\lambda/\overline{AB} \qquad \text{(eq. 2)}$$

wherein $\overline{AB}$ denotes the length of line AB 16. Each line of the form, y=constant, such as line AB 16 is at a different angle $\theta$ to the x,y plane than the other lines of the same form, y=constant. This is shown in FIG. 2 with lines 16, 20, 21, 22 and 24 shown. Each of the lines 16, 20, 21, 22 and 24 is at a different angle $\theta$ to the x,y plane. The tangent of each angle $\theta$ in FIG. 2 is given by the formula:

$$\tan\theta = z/y = ky \qquad \text{(eq. 3)}$$

wherein k is a constant. It follows that each such fan beam 16*a*, 20*a*, 21*a*, 22*a* and 24*a* formed from each such strip associated with respective lines 16, 20, 21, 22 and 24 is pointed in a slightly different direction relative to the y,z plane as shown in FIG. 2. Collectively, the fan beams 16*a*, 20*a*, 21*a*, 22*a* and 24*a* form the composite beam 18, as shown in FIGS. 2 and 3. Thus the strip centered on the x-axis, i.e., at a distance y=0 from the x,z plane and at the angle $\theta=0$ to the x-axis radiates a fan beam centered about the z-axis and fanned widely in the y,z plane with half-power width in the x,z plane again given approximately in degrees by the formula of (eq. 2).

Taken together, the collection of all of the fan beams forms a single beam of half-power width in the x,z plane equal approximately to $2\phi$ wherein $2\phi=2\theta_o$. The angle $2\phi_o$ is the total angle of twist of the wave front as indicated in FIGS. 1 and 2. To find the exact half-power beamwidth in the x,z plane, it is to be noted from FIG. 2 that the $2\phi$ dimension does not include the outer halves of the left most and right most fan beams. Therefore, the half-power beamwidth in the x,z plane is actually equal to $2\phi$ plus one individual beamwidth as recited in the following equations:

$$BW^* = 2\phi + 65\lambda/\overline{AB} \qquad \text{(eq. 4)}$$

or $$BW^* = 2\theta_o + 65\lambda/\overline{AB} \quad \text{(eq. 5)}$$

wherein BW* is the beamwidth of the composite beam made up of all the individual fan beams. This beamwidth BW* is approximately but not exactly constant. The approximation to constancy becomes better at higher and higher frequencies as the wavelength λ gets smaller and smaller. Moreover, although the individual strips were for beams fanned in the y,z plane, it is clear by symmetry that the composite beam formed by the collection of fan beams described above has the same finite and approximately constant beamwidth in the y,z plane as that given above for the x,z plane provided the overall x and y dimension of the twisted planar wave front are the same. This means that when the twisted planar wave front is projected on the x,y plane by lines perpendicular to the z-axis, the resulting projection is square.

The edges of the individual fan beams cancel each other out. The width of each narrow strip on the twisted planar or hyperbolic paraboloidal phase or wave front 10 bordering each line such as 16, can be thought of as being arbitrarily narrow. Therefore, the number of fan beams represented by only 16*a*, 20*a*, 21*a*, 22*a* and 24*a* can in reality be arbitratily large in number. Hence, regardless of the frequency, as long as λ is small compared to the largest allowable values of x and y, or compared to the diameter of a lens that forms the wave front 10, the sector 2φ will be completely filled out by fan beams.

Figure 4:
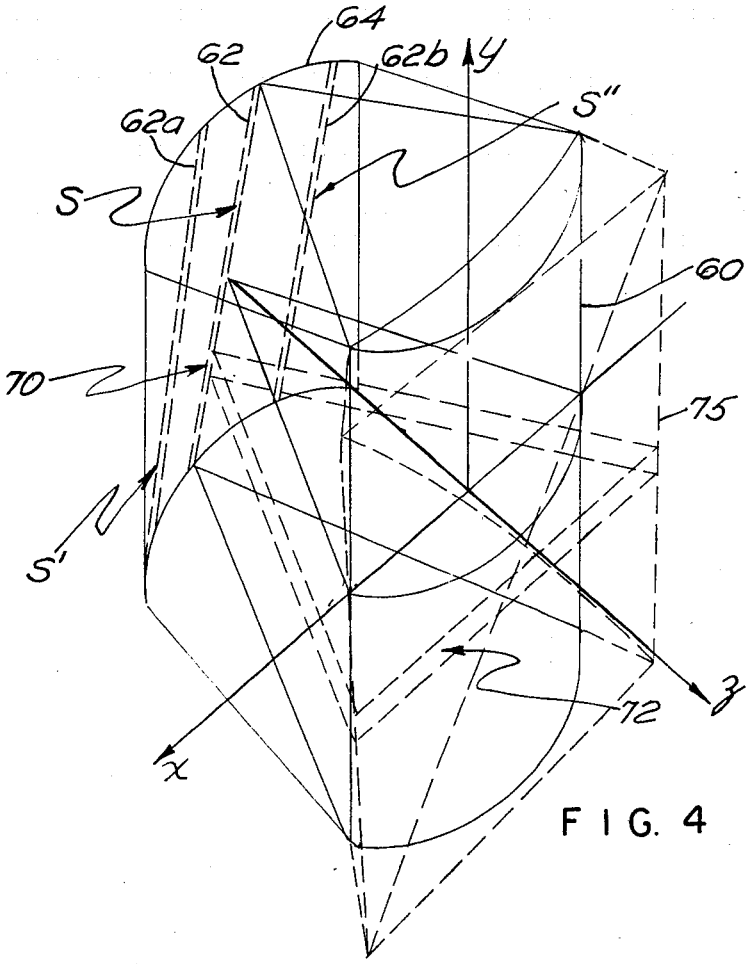
FIG. 4 shows a pictorial representation of the system used for propagating the wave front of FIG. 1 and the fan beams of FIGS. 2 and 3.

Refer now to FIG. 4 wherein there is shown a lens and acoustic retina system for forming one or more twisted planar or hyperbolic paraboloidal phase front or wave front such as 10 of FIG. 1. A cylindrical lens 60 is used in conjunction with a retina of line sources 62 and 62*a*, etc. The line sources 62 are curved slightly, if necessary, to conform with the shape of the focal surface. The line sources 62 and 62*a* are placed at angles to the y-axis while being otherwise mounted generally on the curved cylindrical focal surface 64 of the lens as shown.

Individual elementary sections 70 of each separate line source such as 62 or S illuminate the lens in such a way as to form corresponding strips 72 on a twisted planar, or hyperbolic paraboloidal, phase front or wave front 75, in the immediate near field of the lens as shown dashed in FIG. 4.

In the same general manner as described above, additional straight or slightly curved line sources 62*a* or S' and 62*b*, or S'' as in FIG. 4, can be placed on the focal surface 64 of the lens 60 but off of the central plane of symmetry of the lens 60. This produces additional twisted planar or hyperbolic paraboloidal phase fronts or wave fronts suitable for forming beams with substantially frequency independent, constant beamwidths in scanned directions or for forming multiple simultaneous frequency independent, constant beamwidth beams. Alternatively, a single line source 62 can be moved laterally on the focal surface 64 of the lens to scan a single individual beam.

There has therefore been described a new system for forming substantially frequency independent, constant beamwidth scannable beams or for forming multiple simultaneous frequency independent, constant beamwidth beams. The inventive system eliminates the need for a filter plate in the acoustic lens-acoustic filter plate cases or for elaborate phasing and controlling electronics in the electromagnetic array or acoustic array cases when scanning in one dimension only is required. From a geometrical optics point of view the lens produces a phase front or wave front of a type neither previously produced nor desired from a lens whether optical, acoustical or electromagnetic.

Various alternative ways of shaping the lens to produce the same effect either from one or more line or point sources, may suggest themselves to those skilled in the art although the mathematics involved in the design may become more complicated. Materials of construction in any case may be any standard materials used for fabrication of optical, acoustic or electromagnetic lenses, as the case may be. Clearly, by choosing the overall x and y dimensions of the antenna to have different values such that the projection of the twisted planar wave front onto the x,y plane by a line perpendicular to the z-axis forms a rectangle with one dimension greater than the other rather than a square, the constant beamwidths in the x,z and y,z or azimuth and elevation planes of the antenna can be made to have different values.

It will be understood that various changes in details, materials, steps and arrangement of parts, which have been herein described and illustrated in order to explain the nature of the invention, may be made by those skilled in the art within the principle and scope of the invention as expressed in the appended claims.

What is claimed is:

1. A constant beamwidth lens antenna comprising:

a cylindrical lens having a longitudinal reference axis parallel to the generators of the cylindrical surface of said cylindrical lens and a curved cylindrical focal surface, said focal surface having a longitudinal reference axis parallel to the longitudinal reference axis of said lens; and a line source conforming with and located on said curved cylindrical focal surface and disposed at a transverse angle with respect to said longitudinal lens reference axis.

2. A scannable constant beamwidth lens antenna comprising:

a cylindrical lens having a longitudinal reference axis parallel to the generators of the cylindrical surface of said cylindrical lens and a curved cylindrical focal surface, said focal surface having a longitudinal reference axis parallel to the longitudinal reference axis of said lens; and a plurality of line sources conforming with and located on said curved cylindrical focal surface, said plurality of line sources are spaced from each other and are disposed at a transverse angle with respect to said longitudinal lens reference axis.

* * * * *